US009505593B2

(12) United States Patent
Poke

(10) Patent No.: US 9,505,593 B2
(45) Date of Patent: Nov. 29, 2016

(54) JACKING DEVICE

(71) Applicant: MSLV Pty Ltd, Whittingham, NSW (AU)

(72) Inventor: Tony Francis Poke, Whittingham (AU)

(73) Assignee: MSLV Pty Ltd., Whittingham, NSW (AU)

( * ) Notice: Subject to any disclaimer, the term of this patent is extended or adjusted under 35 U.S.C. 154(b) by 0 days.

(21) Appl. No.: 14/415,808

(22) PCT Filed: Jul. 19, 2013

(86) PCT No.: PCT/AU2013/000802
§ 371 (c)(1),
(2) Date: Jan. 20, 2015

(87) PCT Pub. No.: WO2014/012148
PCT Pub. Date: Jan. 23, 2014

(65) Prior Publication Data

US 2015/0175393 A1 Jun. 25, 2015

(30) Foreign Application Priority Data

Jul. 20, 2012 (AU) ..... 2012903111

(51) Int. Cl.
*B66F 7/14* (2006.01)
*B66F 3/25* (2006.01)
(Continued)

(52) U.S. Cl.
CPC . *B66F 3/25* (2013.01); *B66F 3/10* (2013.01); *B66F 3/24* (2013.01); *B66F 3/46* (2013.01); *B66F 13/00* (2013.01); *F15B 15/264* (2013.01); *F15B 15/16* (2013.01)

(58) Field of Classification Search
CPC ..... B66F 3/25; B66F 13/00; B66F 3/46; B66F 3/24; B66F 3/10; F15B 15/264; F15B 15/16
See application file for complete search history.

(56) References Cited

U.S. PATENT DOCUMENTS 5,722,304 A * 3/1998 Allen ..... F16H 25/20 254/102
6,142,501 A 11/2000 Fogo et al.
(Continued)

FOREIGN PATENT DOCUMENTS

| | | | |
|---|---|---|---|
| CN | 201458645 | U | 5/2010 |
| EP | 0538208 | A1 | 4/1993 |
| SU | 931698 | B | 6/1982 |

OTHER PUBLICATIONS

International Search Report corresponding to PCT/AU2013/000802 dated Aug. 29, 2013, four pages.
International Preliminary Report on Patentability corresponding to PCT/AU2013/000802 dated May 16, 2014, four pages.

*Primary Examiner* — Monica Carter
*Assistant Examiner* — Nirvana Deonauth
(74) *Attorney, Agent, or Firm* — Kilpatrick Townsend & Stockton LLP

(57) ABSTRACT

A jacking device includes a base member, an upper member, and, at least one intermediate member. Each member includes screw threads adapted to engage a respective screw thread of an adjacent member. Drive means is included to permit movement of the members, and to thereby raise or lower an upper surface of the jacking device. The intermediate member may rotate as the drive means operates, but the upper and lower surfaces are preferably prevented from undergoing rotational movement. A plurality of such jacking devices may be operated simultaneously to raise or lower a load or other object.

10 Claims, 5 Drawing Sheets

(51) Int. Cl.

| | |
|---|---|
| ***B66F 3/10*** | (2006.01) |
| ***B66F 3/24*** | (2006.01) |
| ***B66F 3/46*** | (2006.01) |
| ***B66F 13/00*** | (2006.01) |
| ***F15B 15/26*** | (2006.01) |
| *F15B 15/16* | (2006.01) |

(56) References Cited

U.S. PATENT DOCUMENTS

2011/0049450 A1* 3/2011 Hager ..... B66D 1/12
254/343

2012/0132873 A1 5/2012 Few

* cited by examiner

JACKING DEVICE

BACKGROUND OF THE INVENTION

The present invention relates to a jacking device, and in particular, to a propping or jacking device which can prop or jack a load or object above a substrate surface and then retain it in an elevated position.

The present invention has particular application to lifting heavy objects, such as vehicles or other machinery and in particular, mining and earthmoving equipment, which are traditionally initially jacked up and then packing material is typically supplied thereunder, such that persons or other equipment may thereafter work below the elevated surface machinery or other load, with a relative degree of safety.

DESCRIPTION OF THE PRIOR ART

The reference in this specification to any prior publication (or information derived from it), or to any matter which is known, is not, and should not be taken as, an acknowledgement or admission or any form of suggestion that prior publication (or information derived from it) or known matter forms part of the common general knowledge in the field of endeavour to which this specification relates.

At present, to perform maintenance and repair of heavy machinery, such as in earthmoving and mining applications, when it is necessary for a person and or service equipment to access the underside of the machinery to be repaired, jacks are normally used.

Such jacks are typically hydraulic or pneumatic jacks, which rely on fluid being maintained under constant high pressure. Once the equipment is jacked up, maintenance personnel typically move under the machinery to carry out the required repair work.

Such hydraulic systems are known to occasionally fail, or leak, which can result in a slow or sudden failure of the system, with potentially catastrophic effects.

This can have occupational health and safety implications, and in many situations, can be quite dangerous. In some situations, maintenance and repair personnel may spend considerable time, typically hours, in this hazardous environment below a heavy load, with only a hydraulic system keeping the machinery in place. The risk can be further increased in many outdoor environments, for example in windy situations, where the machinery is at a fairly high risk of being blown, slipping, or otherwise falling over.

In some situations, this risk may be somewhat minimised, by using packing. That is, after the one or more jack initially lifts the huge machinery to the required elevation, a packing material may be installed thereunder. The packing material suspends the equipment in the elevated position, such that service personnel and maintenance equipment may move about under the elevated equipment. The aforementioned risk is therefore minimised somewhat, as the personnel are only in high danger for as long as it takes them to install the packing material.

Once the maintenance or repair work is completed, the jacks then re-elevate machinery, such that personnel can then remove the packing material, and the equipment may then be lowered to its normal operational position. The personnel are therefore again placed at risk during this packing removal operation.

The Applicant of the present invention has hereinbefore invented a device which overcomes many of the described disadvantages of the prior art. The Applicant's earlier device is described in International Application No. PCT/AU2008/001218, the entire contents of which should be considered to be incorporated herein by this reference thereto.

The Applicant's earlier device provides a jacking device, including:

a base member, adapted to engage a substrate surface;

a movable member, movable relative to said base member, having an upper surface adapted to engage an object to be raised or lowered;

a threaded shaft associated with either said base member or said movable member;

a guide means associated with the other of said base member or said movable member, said guide means including a threaded surface which is adapted to cooperate with said threaded shaft; and drive means, adapted to rotate said threaded shaft and/or said guide means such that said movable member is permitted to be moved relative to said base member to thereby raise or lower said upper surface.

SUMMARY OF THE INVENTION

The present invention seeks to overcome the disadvantages of the prior art or at least provide an alternative to the prior art devices.

The present invention seeks to provide a jacking device which includes added safety features.

The present invention also seeks to provide a telescoping device which may be compactly stored, and which may elevate a load to a relatively high elevation.

In one broad form, the present invention provides a jacking device, including:

a base member, including a base surface adapted to engage a substrate surface, and, a base screw thread;

an upper member, having an upper surface adapted to engage an object to be raised or lowered, including a screw thread, at least one intermediate member, positioned between said base member and said upper member, each intermediate member including first and second screw threads adapted to engage a respective screw thread of an adjacent member; and drive means, adapted to permit movement of at least one of said members relative to its adjacent member to thereby raise or lower said upper surface.

Preferably, said drive means includes a primary drive means and a backup drive means, each drive means being selected from an electric drive motor, a hydraulic or pneumatic cylinder and/or other drive means.

Also preferably, said device is substantially tubular in shape, wherein said base screw thread is provided on an inner surface of said base member, wherein said upper screw thread is provided on an outer surface of said upper member, and, wherein said first and second screw threads are provided on the inner and outer surfaces of the or each intermediate member.

Preferably, the jacking device further includes a linear bearing which substantially prevents rotational movement of said upper and base members as said drive means is operated.

Preferably, the jacking device also further includes a gear device, adapted to permit rotation of said intermediate member as said drive means is operated.

Preferably, said gear device includes:

a first gear wheel operatively attached to said linear bearing, and adapted to be driven by said drive means; and, a second gear wheel operatively attached to said intermediate member, and operatively engaged with said first gear wheel, which is adapted to permit rotation of said intermediate member as said drive means is rotated.

Also preferably, the jacking device is embodied wherein said gear device is driven by an electric drive means.

Also preferably, the jacking device includes a hydraulic cylinder drive means to substantially vertically raise/lower said upper surface relative to said base surface.

The jacking device further preferably also includes a controller, operable by a user, to control the raising/lowering of said jacking device and to operate said drive means.

Preferably, said controller controls the simultaneous operation of a pair of drive means to thereby effect substantially vertically movement of said upper surface relative to said base surface via a first drive means, and, permit cooperative rotational movement of said intermediate member via a second drive means.

Preferably also, said first drive means includes a hydraulic cylinder and said second drive means includes an electric drive motor.

Preferably, when said upper surface is moved to a final position, said hydraulic cylinder retracts slightly such that said screw threads substantially support any load on said jacking device.

Also preferably, when said upper surface is to be moved, said hydraulic cylinder is raised slightly to relieve any load provided on said screw threads, and then said hydraulic cylinder and said drive motor are substantially simultaneously operated to effect raising/lowering of said jacking device.

Preferably, said controller is operable by said user via a keyboard, PDA or other input device operatively connected to said controller via a communications channel, including via a wired or wireless channel provided either locally to or remotely from said jacking device.

Also preferably, said jacking device is operatively connected to at least one other jacking device, the jacking devices being controlled to separately or simultaneously operate to lift a load.

In a further broad form, the present invention provides a method of operating a jacking device.

The method preferably includes positioning at least one jacking device, as claimed in any one of claims 1 to 15, intermediate a substrate surface and said load;

operating a controller to control the raising or lowering of an upper surface and thereby raise or lower said load.

Also preferably, a plurality of jacking devices are positioned intermediate the substrate surface and said load, and, wherein said controller receives input information from a user and each of said plurality of jacking devices to control the raising or lowering of said load.

BRIEF DESCRIPTION OF THE DRAWINGS

The present invention will become more fully understood from the following description of preferred but non-limiting embodiments thereof, described in connection with the accompanying drawings wherein.

DETAILED DESCRIPTION OF PREFERRED EMBODIMENTS

Figure 1:
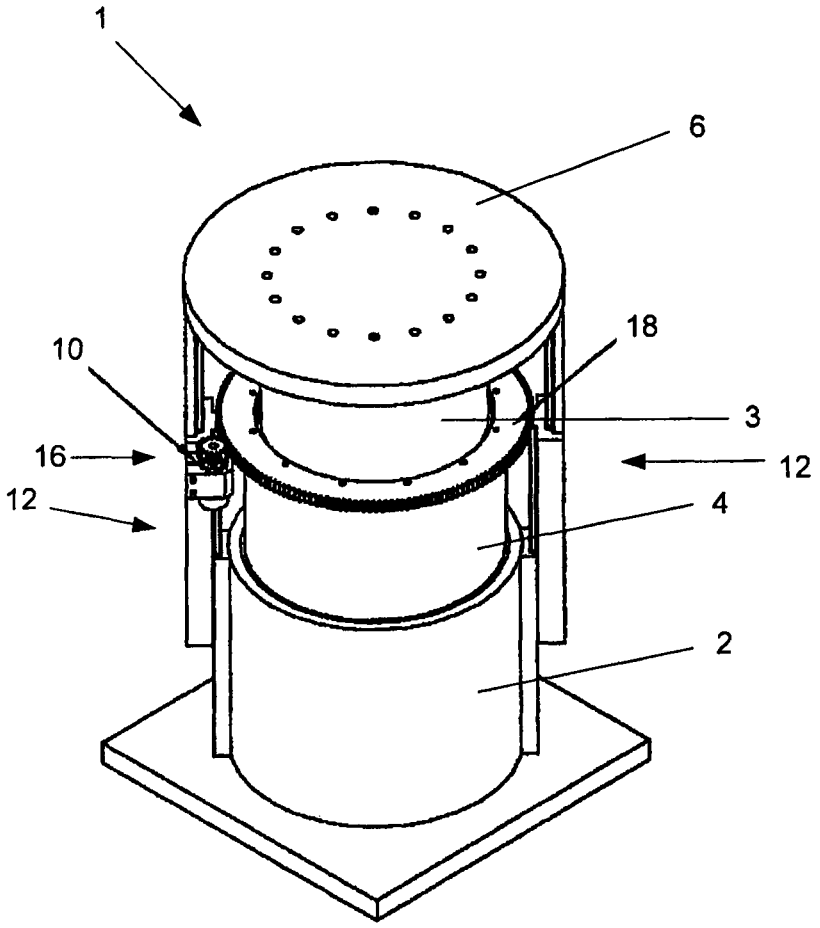
FIG. 1 illustrates an isometric view of the jacking device in accordance with a preferred embodiment of the present invention in an extended position.
Figure 2:
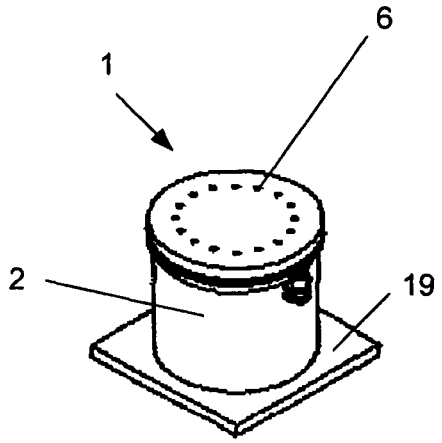
FIG. 2 illustrates the device shown in FIG. 1 but in the retracted position.
Figure 3:
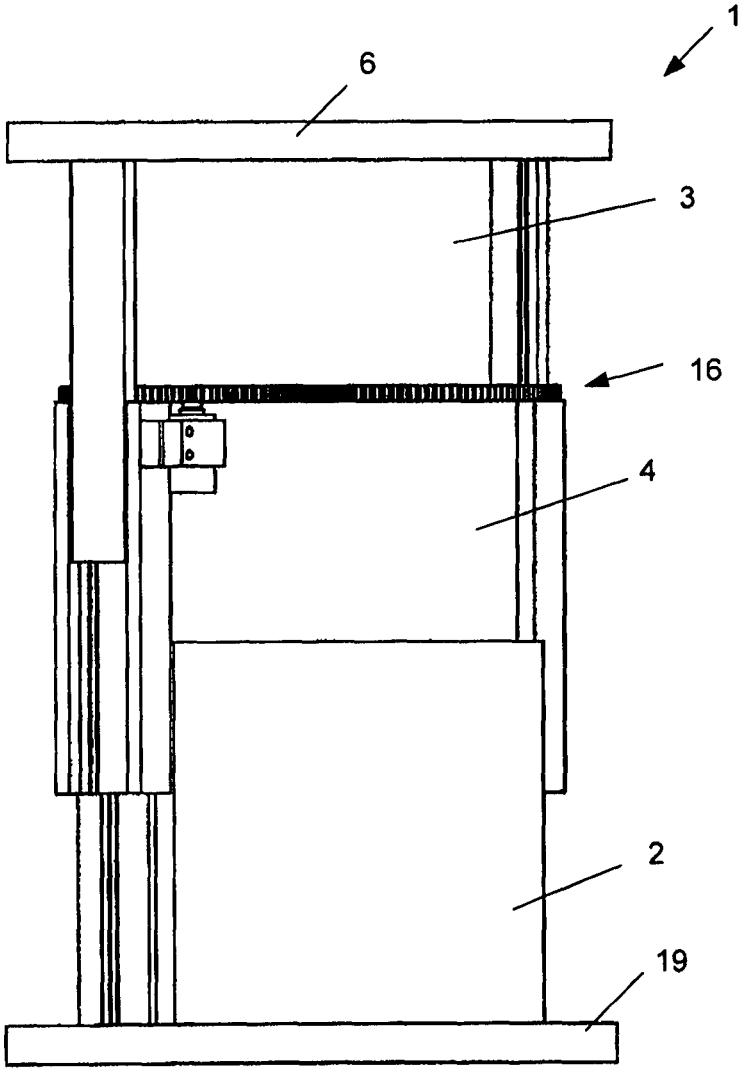
FIG. 3 illustrates an elevational view of the device of FIG. 1.
Figure 5:
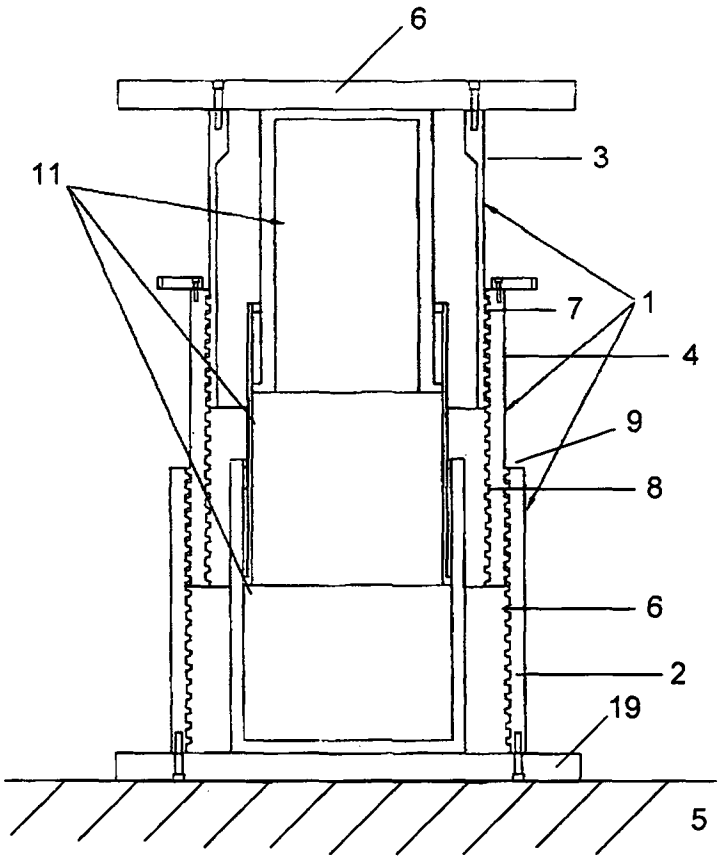
FIG. 5 shows a sectional view of the device.
Figure 4:
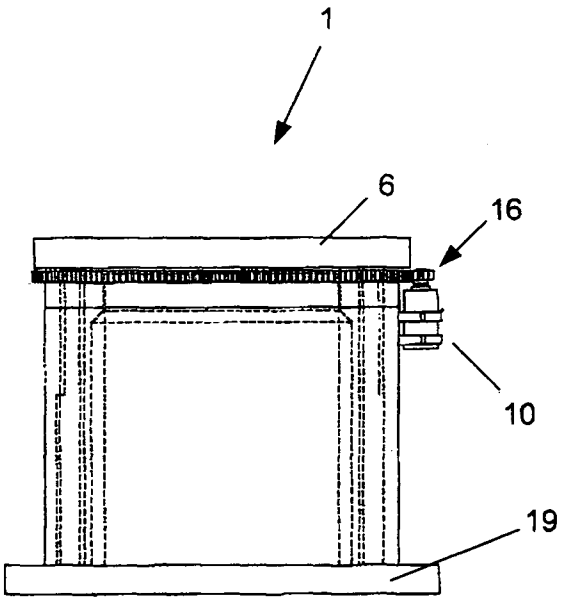
FIG. 4 illustrates an elevational view of the device of FIG. 2 in the compressed position.
Figure 6:
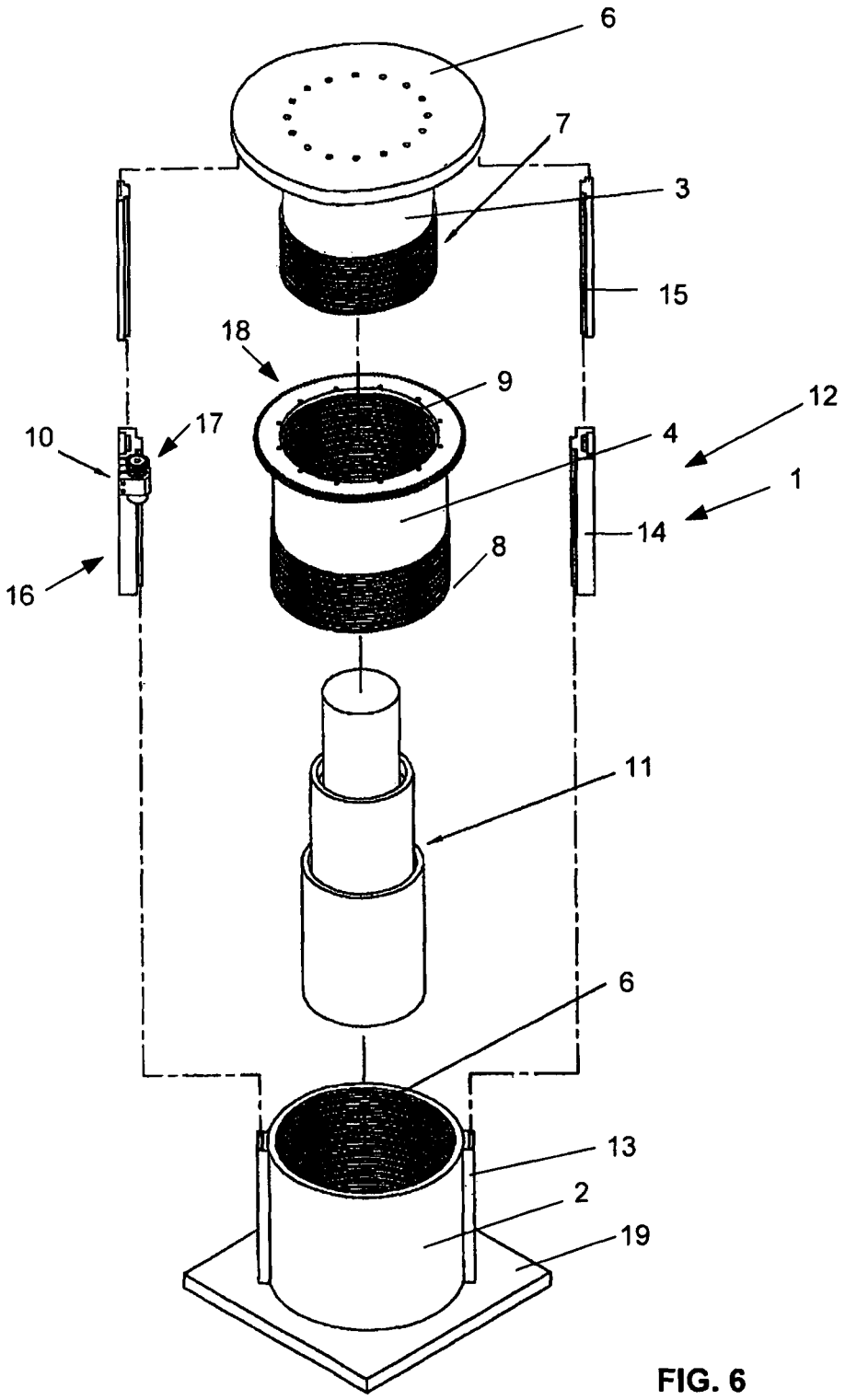
FIG. 6 shows an exploded view of the device of the present invention.

Throughout the drawings, like numerals will be used to identify similar features, except where expressly otherwise indicated.

The jacking device 1, which is typically substantially tubular/cylindrical in shape, includes a base member 2, an upper member 3, and, at least one intermediate member 4.

The base member 1 includes a base surface 19 adapted to engage a substrate surface 5, and includes a screw thread 6, which is shown to be provided on an inner surface of the base member 2.

The upper member 3 has an upper surface 6 which is adapted to engage a load or object to be raised or lowered. The upper member 3 is shown to be provided with a screw thread 7 on its outer surface.

An intermediate member 4 is provided between the base member 2 and the upper member 3. Additional intermediate members 4 could optionally be provided. Each intermediate member 4 includes screw threads 8 and 9, provided on the outer and inner surfaces of the intermediate member 4, to engage with and cooperate with the screw threads of the adjacent members.

In the drawings, screw thread 8 on the outer surface of intermediate member 4 engages and cooperates with screw thread 6 on the inner surface of base member 2. Also, screw thread 9 on the inner surface of intermediate member 4 engages and cooperates with screw thread 7 on the outer surface of upper member 3.

Drive means permits movement of each member 2, 3 and 4 relative to its adjacent member. For example, intermediate member 4 is adapted to rotate and move upwards or downwards relative to base member 2. Upper member 3 is adapted to move upwards and downwards relative to intermediate member 4. Upper member 3 is preferably restricted from rotating axially as it is raised or lowered, as will be hereinafter described.

A drive means may be embodied in a variety of forms. The drive means shown in the drawings illustrates a primary drive means embodied as a two stage telescopic hydraulic cylinder 11, and, an electric drive motor 10. It will however be appreciated by persons skilled in the art that other versions of drive means may be embodied to achieve similar functions.

Also shown in the drawings is the inclusion of a linear bearing 12 on each side of the device 1 which permits vertical raising/lowering of the upper surface 6 whilst substantially preventing rotation of movement of the upper member 3 relative to the base member 2 but whilst still permitting rotational movement of the intermediate member 4. The linear bearing 12 typically includes three components, namely a base component 13, an intermediate component 14 and an upper component 15 each of which slidably connect to substantially prevent rotational movement of the upper member 3 relative to base member 2.

Also shown in the drawings is the provision of a gear device 16 which includes a first gear or smaller gear 17 which is operatively attached to the linear bearing 16 and is adapted to be driven by drive motor 10, and, a second gear 18 which is operatively attached to the intermediate member 4 and which operatively engages with the first gear wheel 17, and which is adapted to rotate the intermediate member 4 as the drive means 10 is rotated. This gearing device 16 is preferably driven by an electric drive means 10.

A hydraulic cylinder 11 is also provided which substantially vertically raises or lowers the upper member 3 relative to the base member 2. Illustrated is a two stage telescopic hydraulic cylinder, but it will be appreciated that other appropriate drive means may be alternatively provided.

To operate the device, a controller is preferably provided which is operable by a user to control the raising or lower of the jacking device and to operate the drive means.

Figure 7:
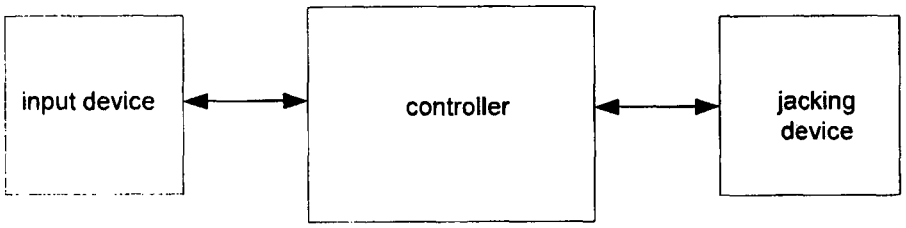
FIG. 7 shows a diagram of the controller to operate the jacking device; and, FIG. 8 shows a diagram showing the control of a plurality of jacking devices.
Figure 8:
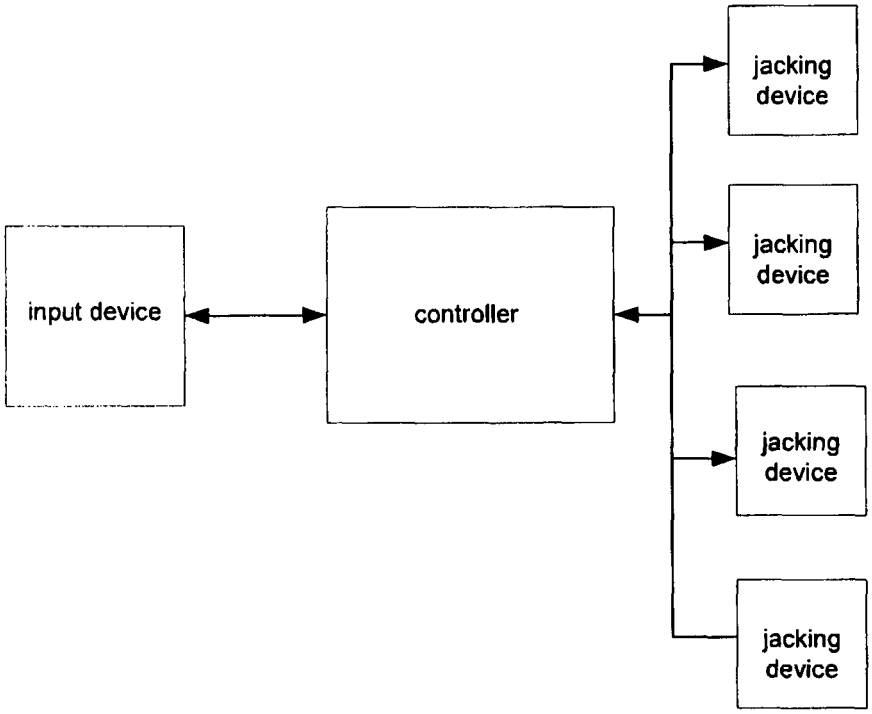

As shown in FIGS. 7 and 8, the controller may control the operation of one or more jacking devices, via a user operated input device. The user operated input device may be a keyboard, computer, PDA or other input device into which a user may input instructions. It may be provided local to the jacking device or remotely, via a wired or wireless communications device.

The controller may control the simultaneous operation of a plurality of jacking devices 1, and for each device control the pair of drive means 10 and 11 to thereby effect substantially vertical movement of the upper member 3 relative to the base member 2 via a first drive means 11 and, cooperative rotational movement of the intermediate member 4 via a second drive means 10.

The first drive means 11 is preferably embodied as a hydraulic cylinder, and the second drive means 10 is preferably embodied as an electric drive motor. Alternatives will be apparent to persons skilled in the art.

In use, the basic operation may typically be as follows. As hydraulic pressure is supplied to the telescopic cylinder 11 from a high pressure circuit, low pressure may be applied to the screw drive motor 10.

Any load is lifted substantially by the hydraulic cylinder 11 whilst the screw drive motor 10 rotates the intermediate member 4 to "follow" the hydraulic cylinder 11 by screwing itself out of the lower base member 2 and simultaneously extending the upper member 3.

Once in the elevated position, the hydraulic cylinder 11 slightly retracts whilst the screw is held stationary so the load is now bearing on the screw thread alone. This effectively packs the load by automatic mechanical means.

To lower the load, the hydraulic cylinder 11 is first operated to travel up slightly to relieve the load from the screw threads and to allow it to begin to rotate in the down direction. At this point, the cylinder 11 then switches to the down direction with the screw thread staying just ahead of it. If at any stage the hydraulic cylinder 11 or hoses should fail, the load will be instantaneously transferred to the screw threads while traveling in either direction.

It will therefore be understood by a person skilled in the art that once in the locked position, in the event of any failure, which can occasionally occur in hazardous situations, the sudden or slow failure of the system should be overcome. Maintenance and repair personnel and equipment can therefore be safely brought underneath any heavy load with the risk of any accidental falling of the load being substantially minimized.

It will be appreciated that in use, a plurality of such jacking devices may be simultaneously used. Control circuitry may be used to simultaneously operate the various drive means, etc such that correct proportional balancing of the load via a number of these jacking devices may be achieved. Various sensors or monitors may be used to ensure that each of the devices either operates in unison or as otherwise required, to take into consideration variations such as unequal load distribution, environment factors such as wind, etc.

It will be appreciated by persons skilled in the art that numerous variations and modifications may be made to the jacking device as hereinbefore described. All such variations and modifications which become apparent to persons skilled in the art should be considered to fall within the spirit and scope of the invention as broadly hereinbefore described.

The invention claimed is:

1. A jacking device, including:

a base member, including a base surface adapted to engage a substrate surface, having a base screw thread;

an upper member, including an upper surface adapted to engage a load to be raised or lowered, having an upper screw thread;

at least one intermediate member, positioned between said base member and said upper member, each intermediate member including first and second screw threads adapted to engage a respective screw thread of an adjacent member;

drive means, adapted to permit relative movement of each of said members to thereby raise or lower said upper surface, said drive means including:

a primary hydraulic drive cylinder positioned between said base surface and said upper surface to substantially raise/lower said upper surface relative to said base surface; and, a backup drive motor to rotate each intermediate member;

a linear bearing, to substantially prevent rotational movement of said upper and base members whilst permitting rotation of each intermediate member as said drive means is operated;

a controller, operable by a user to control the raising/lowering of said jacking device by simultaneously controlling operation of said hydraulic drive cylinder to effect substantially vertical movement of said upper surface relative to said lower surface, whilst controlling cooperative rotational movement of each intermediate member via said backup drive motor.

2. The jacking device as claimed in claim 1, wherein said device is substantially tubular in shape, wherein said base screw thread is provided on an inner surface of said base member, wherein said upper screw thread is provided on an outer surface of said upper member, and, wherein said first and second screw threads are provided on the inner and outer surfaces of each intermediate member.

3. The jacking device as claimed in claim 1, including a gear device including:

a first gear wheel operatively attached to said linear bearing, and adapted to be driven by said backup motor; and, a second gear wheel operatively attached to said intermediate member, and be operatively engaged with said first gear wheel, which is adapted to permit rotation of said intermediate member as said backup motor is rotated.

4. The jacking device as claimed in claim 1, wherein, when said upper surface is moved to a final position, said hydraulic cylinder retracts slightly such that said screw threads substantially support any load on said jacking device.

5. The jacking device as claimed in claim 1, wherein, when said upper surface is to be moved, said hydraulic cylinder is raised slightly to relieve any load provided on said screw threads, and then said hydraulic cylinder and said backup drive motor are substantially simultaneously operated to effect raising/lowering of said jacking device.

6. The jacking device as claimed in claim 1, wherein said controller is operable by said user via a keyboard, PDA or other input device operatively connected to said controller via a communications channel, including via a wired or wireless channel provided either locally to or remotely from said jacking device.

7. The jacking device as claimed in claim 1, operatively connected to at least one other jacking device, the jacking devices being controlled to separately or simultaneously operate to lift a load.

8. The jacking device as claimed in claim 1, wherein said backup drive motor includes an electric or hydraulic drive motor.

9. A method of jacking a load, including the steps of:

positioning at least one jacking device, as claimed in claim 1, intermediate a substrate surface and said load;

operating the controller to control the raising or lowering of an upper surface and thereby raise or lower said load.

10. The method of jacking a load as claimed in claim 9, wherein a plurality of jacking devices are positioned intermediate the substrate surface and said load, and, wherein said controller receives input information from a user and each of said plurality of jacking devices to control the raising or lowering of said load.

* * * * *